US008096492B2

(12) United States Patent
Makino et al.

(10) Patent No.: US 8,096,492 B2
(45) Date of Patent: Jan. 17, 2012

(54) PULVERIZING AND COARSE POWDER CLASSIFYING APPARATUS AND FINE POWDER CLASSIFYING APPARATUS

(75) Inventors: Nobuyasu Makino, Numazu (JP); Kouji Noge, Numazu (JP); Kenta Kawasumi, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 205 days.

(21) Appl. No.: 12/600,345

(22) PCT Filed: May 14, 2008

(86) PCT No.: PCT/JP2008/059293

§ 371 (c)(1),
(2), (4) Date: Nov. 16, 2009

(87) PCT Pub. No.: WO2008/143267

PCT Pub. Date: Nov. 27, 2008

(65) Prior Publication Data

US 2010/0170973 A1 Jul. 8, 2010

(30) Foreign Application Priority Data

May 15, 2007 (JP) ..... 2007-129357

(51) Int. Cl.
*B02C 23/10* (2006.01)
*B07B 7/00* (2006.01)

(52) U.S. Cl. ..... 241/101.5; 241/79.1; 209/720

(58) Field of Classification Search ..... 241/101.5, 241/79.1, 80; 209/720–723
See application file for complete search history.

(56) References Cited

U.S. PATENT DOCUMENTS

| | | | | |
|---|---|---|---|---|
| 6,368,765 | B2 | 4/2002 | Izu et al. | |
| 6,503,681 | B2 | 1/2003 | Makino et al. | |
| 7,032,849 | B2 | 4/2006 | Takahashi et al. | |
| 7,156,331 | B2 | 1/2007 | Takahashi et al. | |
| 7,318,990 | B2 | 1/2008 | Makino et al. | |
| 7,364,101 | B2 * | 4/2008 | Tanaka et al. | 241/79.1 |
| 7,498,114 | B2 | 3/2009 | Makino et al. | |
| 2002/0092938 | A1 * | 7/2002 | Huang et al. | 241/19 |
| 2003/0178514 | A1 | 9/2003 | Makino et al. | |
| 2005/0003294 | A1 | 1/2005 | Murakami et al. | |
| 2006/0063091 | A1 | 3/2006 | Makino et al. | |
| 2006/0214036 | A1 | 9/2006 | Makino et al. | |
| 2006/0222980 | A1 | 10/2006 | Makino et al. | |
| 2007/0031754 | A1 | 2/2007 | Murakami et al. | |
| 2009/0159730 | A1 | 6/2009 | Makino et al. | |

FOREIGN PATENT DOCUMENTS

| | | |
|---|---|---|
| JP | 58 13956 | 1/1983 |
| JP | 9 236994 | 9/1997 |
| JP | 2766790 | 4/1998 |
| JP | 3493489 | 11/2003 |
| JP | 3531784 | 3/2004 |
| JP | 3731077 | 10/2005 |
| JP | 2007 862 | 1/2007 |

* cited by examiner

*Primary Examiner* — Faye Francis
(74) *Attorney, Agent, or Firm* — Oblon, Spivak, McClelland, Maier & Neustadt, L.L.P.

(57) ABSTRACT

A pulverizing and coarse powder classifying apparatus including: a mechanical pulverizer that pulverizes a powder raw material, a cyclone that collects pulverized powder, and a coarse powder classifier that separates coarse powder from the collected powder, wherein the coarse powder classifier is a cyclone classifier including a dispersion chamber equipped with a center core and used for dispersing the powder, and a classification chamber equipped with a separator core, and wherein the center core has at its center a fine powder discharge pipe.

17 Claims, 6 Drawing Sheets

| | | | |
|---|---|---|---|
| 5 — 1 | Upper center core | 5 — 5 | Center core |
| 5 — 2 | Classification chamber | 5 — 7 | Fine powder discharge port |
| 5 — 3 | Hopper | 5 — 8 | Separator core |
| 5 — 4 | Primary louver (Secondary airflow vane) | 5 — 5 a | Discharge pipe |

PULVERIZING AND COARSE POWDER CLASSIFYING APPARATUS AND FINE POWDER CLASSIFYING APPARATUS

TECHNICAL FIELD

The present invention relates to an airflow classifying apparatus, particularly a pulverizing and coarse powder classifying apparatus and a fine powder classifying apparatus which perform efficient classification by preventing fine powder and coarse particles from being mixed into powder pulverized by a mechanical pulverizer and which thus make it possible to obtain a powder product with a sharp particle size distribution.

BACKGROUND ART

As to present-day dry toners, there is an increased demand for improvement in image quality with the use of the digital copying system, which necessitates controlling toner particle diameters, in other words which necessitates obtaining toners with a sharp particle size distribution by reducing the proportions of fine powder and coarse powder, and thus there is an increased demand for development of toner producing apparatuses for obtaining toners with a desired particle size distribution.

Conventionally, for a pulverizing apparatus incorporated in a pulverizing and coarse powder classifying apparatus for toner, one or two mechanical pulverizers are used wherein each of the mechanical pulverizers includes a rotor having concavities and convexities on its surface, and a stator whose concave-convex surface is stationarily placed on a circumferential inner side of the rotor, in which a toner raw material is pulverized by means of a vortex generated between the rotor and the stator by rotating the rotor at high speed. Further, fine powder is separated from the pulverized toner raw material by two classifying units joined to the pulverizer/pulverizers, and a toner as a product is thus obtained.

FIG. 1 shows an example of a flow of steps in a conventional toner production process. For example, a pulverizing and coarse powder classifying step employs closed-circuit pulverization, in which a raw material introduced through a raw material supply pipe 1 is pulverized by a pulverizing unit 2, then temporarily collected by a cyclone 4, and introduced to a coarse powder classifying unit 5 where the pulverized raw material is classified into pulverized material and fine powder. Coarse powder is returned to the pulverizing unit 2 via a pipe 3 so as to be pulverized again. Fine powder generated in the pulverizing step is collected by a cyclone 7 via a path 6 and subsequently supplied to a fine powder classifying step. Powders supplied to the classifying unit in the fine powder classifying step include powder of the raw material, and toner with a wide range of particle diameters undergoing a pulverizing process, that has circulated between the pulverizing unit and the classifying unit. Therefore, the powders are of broad particle size distribution, which necessitates lowering the collection rate of a product to attain a desired particle size, and there is an increased amount of toner returned to a mechanical pulverizer that performs closed-circuit pulverization, which necessitates operation with a very large load. In the fine powder classifying step, the toner is further classified by a fine powder classifier 8, and a product is collected in a product collector 9.

Fine powder separated from the product is temporarily collected by a cyclone 11 via a path 10, then introduced to a fine powder classifier 14 via a path 12 so as to be classified again, and coarse particles are returned to the fine powder classifier 8 via a path 13. Meanwhile, fine powder is collected by a cyclone 16 via a path 15, then recovered as a fine powder 17. These fine powder classifiers 8 and 14 can be suitably selected from classifiers for single classification and classifiers for two-staged classification, according to the processing capability.

As described above, since the proportions of coarse powder and fine powder are large in a conventional toner producing method, images obtained using a developer thus produced are unstable in charge amount and variable in density. In other words, excessively pulverized toner, which affects the charge amount of the toner, causes background smear, and insufficiently pulverized toner causes transfer failure that leads to image defects and reduction in image quality. Moreover, in production of toner, an excessive load is applied to a classifier, so that classification efficiency is poor, and pulverizing energy efficiency in pulverization is also poor, which is problematic.

Meanwhile, in a pulverizing method using a jet pulverizer, the number-based percentage of unwanted fine powder is 15% to 50%, which is fairly large. Thus, the fine powder is liable to be mixed into the toner product; further, production efficiency becomes poor because the fine powder needs to be removed, and additional energy is required to reuse the removed fine powder.

Patent Literature 1 discloses a classifier provided with a dispersion section and a classification section, and the like, and Patent Literature 2 discloses a classifier in which a secondary airflow vane is provided on the upper circumference of a raw material supply pipe. However, both the classifiers in Patent Literatures 1 and 2 lack a function for enhancing classification accuracy by increasing the swirling velocity in the classifiers; also, classification takes place only once in the classifiers owing to the structures thereof, which causes reduction in the classification accuracy, and coarse particles are mixed into a pulverized material in classification of coarse powder, whereas fine powder is mixed into a product in classification of fine powder, which causes accuracy reduction. Hence, the conventional classifiers give insufficient pulverizing performance owing to their poor pulverizing capability and power consumption. Further, the particle size and particle size distribution of toner are important in view of image quality; therefore, there is a problem in which toners produced using the classifiers have negative effects on the distribution of charge amount, etc.

[Patent Literature 1] Japanese Utility Model Application Laid-Open (JP-U) No. 58-013956

[Patent Literature 2] Japanese Patent (JP-B) No. 2766790

DISCLOSURE OF INVENTION

The present invention has been devised in light of the problems in the art and is aimed at providing a pulverizing and coarse powder classifying apparatus and a fine powder classifying apparatus which efficiently produce a powder with a sharp particle size distribution by preventing fine powder and coarse particles from being mixed into the powder.

As a result of carrying out earnest examinations, the present inventors have found that the problems can be solved by a cyclone classifier including at least a dispersion chamber equipped with a center core and used for dispersing the powder, and a classification chamber equipped with a separator core, wherein the center core has at its center a fine powder discharge pipe.

Specifically, in order to solve the problems, the pulverizing and coarse powder classifying apparatus and the fine powder classifying apparatus according to the present invention have the technical features described in (1) to (16) below.

(1): A pulverizing and coarse powder classifying apparatus including: a mechanical pulverizer that pulverizes a powder raw material, a cyclone that collects pulverized powder, and a coarse powder classifier that separates coarse powder from the collected powder, wherein the coarse powder classifier is a cyclone classifier including a dispersion chamber equipped with a center core and used for dispersing the powder, and a classification chamber equipped with a separator core, and wherein the center core has at its center a fine powder discharge pipe.

(2): The pulverizing and coarse powder classifying apparatus according to (1), wherein the dispersion chamber includes a secondary airflow vane.

(3): The pulverizing and coarse powder classifying apparatus according to any one of (1) and (2), wherein an apex angle $\alpha 1$ of the center core satisfies the following relationship:

$$90° \leqq \alpha 1 \leqq 140°.$$

(4): The pulverizing and coarse powder classifying apparatus according to any one of (1) to (3), wherein an opening area A1 of the fine powder discharge pipe and an opening area A2 of the separator core satisfy the following relationship:

$$1/10 \times A2 \leqq A1 \leqq 8/10 \times A2.$$

(5): The pulverizing and coarse powder classifying apparatus according to any one of (1) to (4), wherein a length L of the fine powder discharge pipe and an opening diameter D of the separator core satisfy the following relationship:

$$1 \times D \leqq L \leqq 4 \times D.$$

(6): The pulverizing and coarse powder classifying apparatus according to any one of (1) to (5), wherein the coarse powder classifier includes an upper lid which includes a flow maldistribution preventing portion at its center.

(7): The pulverizing and coarse powder classifying apparatus according to any one of (1) to (6), wherein a volume V1 of the flow maldistribution preventing portion and a volume V2 of the dispersion chamber satisfy the following relationship:

$$3/10 \times V2 \leqq V1 \leqq 8/10 \times V2.$$

(8): The pulverizing and coarse powder classifying apparatus according to any one of (1) to (7), wherein a basal area VA1 of the flow maldistribution preventing portion and a cross-sectional area VA2 of the dispersion chamber in an a-a' direction satisfy the following relationship:

$$2/10 \times VA2 \leqq VA1 \leqq 7/10 \times VA2.$$

(9): The pulverizing and coarse powder classifying apparatus according to any one of (1) to (8), wherein the pulverizing and coarse powder classifying apparatus employs closed-circuit pulverization.

(10): A fine powder classifying apparatus including: a dispersion chamber equipped with a center core and used for dispersing powder, and a classification chamber equipped with a separator core, wherein the fine powder classifying apparatus is a cyclone classifier, and the center core has at its center a fine powder discharge pipe, wherein the fine powder classifying apparatus separates fine powder from the powder from which coarse powder has been separated by a pulverizing and coarse powder classifying apparatus, and wherein the pulverizing and coarse powder classifying apparatus comprises a mechanical pulverizer that pulverizes a powder raw material, a cyclone that collects pulverized powder, and a coarse powder classifier that separates the coarse powder from the collected powder, in which the coarse powder classifier is a cyclone classifier including a dispersion chamber equipped with a center core and used for dispersing the powder, and a classification chamber equipped with a separator core, and in which the center core has at its center a fine powder discharge pipe.

(11): The fine powder classifying apparatus according to (10), wherein the dispersion chamber includes a secondary airflow vane.

(12): The fine powder classifying apparatus according to any one of (10) and (11), wherein an apex angle $\alpha 1$ of the center core satisfies the following relationship:

$$90° \leqq \alpha 1 \leqq 140°.$$

(13): The fine powder classifying apparatus according to any one of (10) to (12), wherein an opening area A1 of the fine powder discharge pipe and an opening area A2 of the separator core satisfy the following relationship:

$$1/10 \times A2 \leqq A1 \leqq 8/10 \times A2.$$

(14): The fine powder classifying apparatus according to any one of (10) to (13), wherein a length L of the fine powder discharge pipe and an opening diameter D of the separator core satisfy the following relationship:

$$1 \times D \leqq L \leqq 4 \times D.$$

(15): The fine powder classifying apparatus according to any one of (10) to (14), further including an upper lid which includes a flow maldistribution preventing portion at its center.

(16): The fine powder classifying apparatus according to any one of (10) to (15), wherein a volume V1 of the flow maldistribution preventing portion and a volume V2 of the dispersion chamber satisfy the following relationship:

$$3/10 \times V2 \leqq V1 \leqq 8/10 \times V2.$$

(17): The fine powder classifying apparatus according to any one of (10) to (16), wherein a basal area VA1 of the flow maldistribution preventing portion and a cross-sectional area VA2 of the dispersion chamber in an a-a' direction satisfy the following relationship:

$$2/10 \times VA2 \leqq VA1 \leqq 7/10 \times VA2.$$

According to the pulverizing and coarse powder classifying apparatus of the present invention, improvement in classifier accuracy makes smaller the amount of coarse powder mixed into a product than in the case of a conventional pulverizing and coarse powder classifying apparatus, and at the same time it is possible to reduce the occurrence of fine powder, so that the pulverizing and coarse powder classifying apparatus is economically advantageous in terms of production efficiency.

According to the fine powder classifying apparatus of the present invention, the swirling velocity in the classifier is stabilized, improvement in classifier accuracy makes smaller the amount of fine powder mixed into a product than in the case of a conventional pulverizing and classifying apparatus, and at the same time it is possible to reduce the occurrence of fine powder, so that the fine powder classifying apparatus is economically advantageous in terms of production efficiency.

Furthermore, according to the pulverizing and coarse powder classifying apparatus and the fine powder classifying apparatus of the present invention, the amount of fine powder contained can be easily controlled, and thus powder which remains stable in particle diameter for a long period of time can be obtained.

Figure 1:
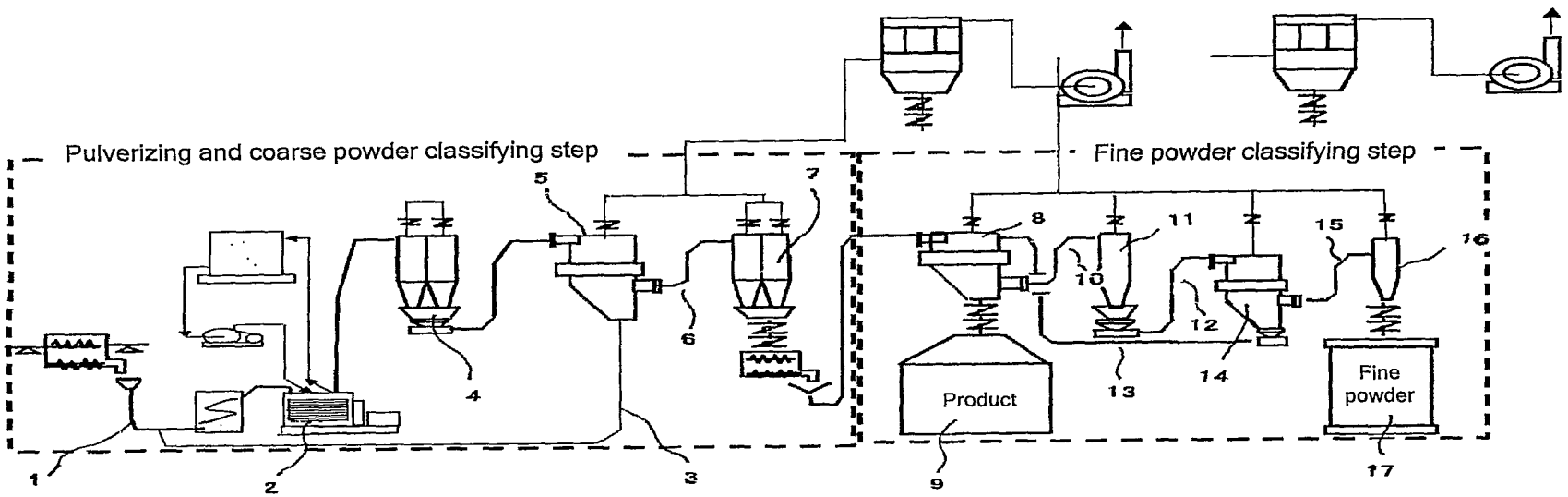
FIG. 1 is a flow diagram showing a flow of steps in a process of producing powder, and the names of devices.

BEST MODE FOR CARRYING OUT THE INVENTION (Pulverizing and Coarse Powder Classifying Apparatus)

The pulverizing and coarse powder classifying apparatus of the present invention is a pulverizing and coarse powder classifying apparatus including: a mechanical pulverizer that pulverizes a powder raw material, a cyclone that collects pulverized powder, and a coarse powder classifier that separates coarse powder from the collected powder, wherein the coarse powder classifier is a cyclone classifier including a dispersion chamber equipped with a center core and used for dispersing the powder, and a classification chamber equipped with a separator core, and wherein the center core has at its center a fine powder discharge pipe.

(Fine Powder Classifying Apparatus)

The fine powder classifying apparatus of the present invention is a fine powder classifying apparatus including: a dispersion chamber equipped with a center core and used for dispersing powder, and a classification chamber equipped with a separator core, wherein the fine powder classifying apparatus is a cyclone classifier, and the center core has at its center a fine powder discharge pipe, and wherein the fine powder classifying apparatus separates fine powder from powder from which coarse powder has been separated by the pulverizing and coarse powder classifying apparatus.

Also, the classifiers employed in the pulverizing and coarse powder classifying apparatus and the fine powder classifying apparatus of the present invention can be suitably used in classifying powder produced by a mechanical pulverizer as well as in classifying powder produced by a polymerization method.

The basic structures of the pulverizing and coarse powder classifying apparatus and the fine powder classifying apparatus of the present invention will be explained below.

Since the following embodiments represent suitable embodiments of the present invention, there are various technically suitable limitations on them. However, it should be noted that the present invention is not limited to these embodiments as long as there is no particular mention of the present invention being limited thereto in explanations below.

EXAMPLES

First Embodiment

Before explaining a first embodiment of a coarse powder classifier used in the pulverizing and coarse powder classifying apparatus of the present invention, the structure of a conventional classifier will be explained with reference to FIG. 2. This classifier is used as a coarse powder classifier 5 in the coarse powder classifying step shown in FIG. 1. This coarse powder classifier may employ two or more-staged classification, depending upon the productivity, facility configuration, etc. In the cyclone classifier, a toner jet introduced from 2-4 is swirled by an upper center core 2-1 and thus dispersed, then passes a center core 2-5 placed at a lower part of a collector, and flows into a classification chamber 2-2. A separator core 2-8 and a louver 2-9 are placed in the vicinity of the classification chamber, and the swirling flow is further accelerated as secondary air is sucked in through the louver by suction of a blower from a discharge port 2-12 at the center of the separator core. Thus, fine powder is collected at the center of the separator core by centrifugal force, whereas coarse powder is passed through a gap 2-6 between the louver and the separator core and collected at a hopper 2-3. Suitable examples of this conventional classifier include DS CLASSIFIER manufactured by Nippon Pneumatic Mfg. Co., Ltd.

Figure 3:
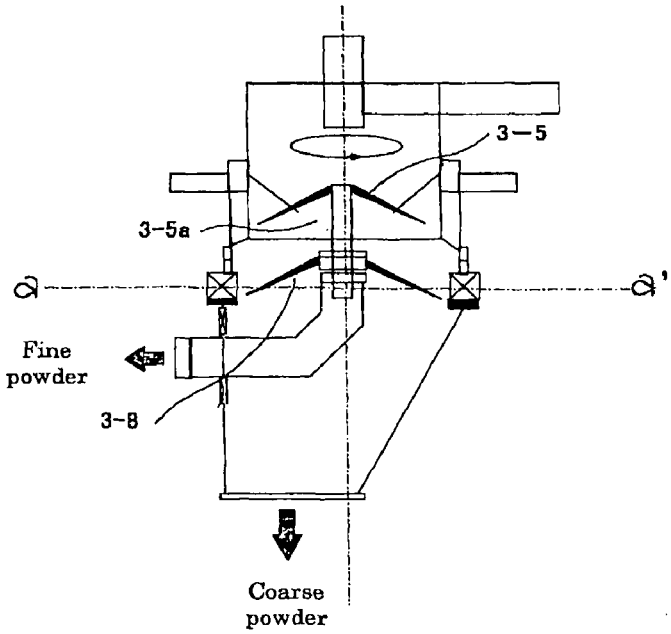
FIG. 3 is a schematic diagram showing the structure according to one embodiment of a classifier of the present invention.

A first embodiment of a coarse powder classifier used in the pulverizing and coarse powder classifying apparatus of the present invention is shown in FIG. 3. This classifier is applied to a coarse powder classifier in the pulverizing and classifying step shown in FIG. 1.

In the present embodiment, in addition to the components of the conventional classifier in FIG. 2, a discharge pipe (which hereinafter denotes a fine powder discharge pipe) 3-5*a* is installed at the center of a center core 3-5 of a cyclone classifier in such a manner as to face a separator core 3-8 in a classification chamber. When a pulverized material flows in circles inside a collector inner portion 1 after flowing from a collector inlet 4, the swirling velocity of the pulverized material is further increased by suction of the discharge pipe 3-5*a*, and the swirling velocity becomes higher than that inside a collector inner portion of a conventional classifier, thereby improving dispersibility. At the same time, due to the dispersion, ultra-fine powder contained in the pulverized material is discharged from the discharge pipe 3-5*a* to the fine powder side via a fine powder discharge port 2-7 of the separator core provided in the classification chamber 2-2.

In a conventional dispersion chamber as well, classifying function is added, and ultra-fine powder is separated beforehand through the discharge pipe 3-5*a*. Specifically, since the discharge pipe 3-5*a* makes two-staged classification possible within the same classifier, classification accuracy improves remarkably.

For a pulverizing apparatus, a known one can be used as long as it is a mechanical pulverizer using a rotor which rotates. For example, pulverization and classification are carried out using TURBO MILL manufactured by Turbo Kogyo Co., Ltd.

A toner was produced as described below, using the pulverizing and coarse powder classifying apparatus of the present embodiment.

A mixture of 75% by weight of polyester resin, 10% by weight of styrene-acrylic copolymer resin and 15% by weight of carbon black was melted and kneaded using a roll mill, and after the mixture was cooled and solidified, it was coarsely pulverized using a hammer mill to yield a toner raw material. Then the toner raw material was pulverized using a turbo mill that is a mechanical pulverizer, and by replacing the coarse powder classifier 5 in the pulverizing and coarse powder classifying step and the fine powder classifying step shown in FIG. 1 with the classifier shown in FIG. 3, it was possible to obtain a toner whose weight-average particle diameter was 8.0 μm, in which the number-average percentage of fine powder of 4 μm or less in particle diameter was 12% by number and the weight-average percentage of coarse powder of 16 μm or less in particle diameter was 1.0% by weight, by as much as 85% by weight (relative to the total amount of toner) at a raw material feed rate of 200 kg/hr.

For the measurement of the particle diameters, MULTISIZER manufactured by Beckman Coulter, Inc. was used.

Additionally, when pulverization and classification were carried out in the flow of steps shown in FIG. 1, using the same kneaded product as that used in the classifier of the present embodiment, it was possible to obtain a toner whose weight-average particle diameter was 7.8 μm, in which the number-average percentage of fine powder of 4 μm or less in particle diameter was 17% by number and the weight-average percentage of coarse powder of 18 μm or less in particle diameter was 2.5% by weight, by as much as 80% by weight (relative to the total amount of toner) at a raw material feed rate of 200 kg/hr.

Second Embodiment

Before explaining a second embodiment of a coarse powder classifier used in the pulverizing and coarse powder classifying apparatus of the present invention, the structure of a conventional classifier will be explained with reference to FIG. 4. This classifier is used for the coarse powder classifier 5 in the coarse powder classifying step shown in FIG. 1. This coarse powder classifier may employ two or more-staged classification, depending upon the productivity, facility configuration, etc. In the cyclone classifier, when a toner jet introduced from 4-4 is swirled by an upper center core 4-1, outer air is sucked through a primary louver (which hereinafter denotes a secondary airflow vane) 4-4*a* placed in the vicinity of a collector 4-1, and thus the swirling capability of the swirling flow is improved in comparison with classifiers without primary louvers. After dispersed, the toner jet passes a center core 4-5 placed at a lower part of the collector and then flows into a classification chamber 4-2. A separator core 4-7 and a louver 4-9 are placed in the vicinity of the classification chamber, and the swirling flow is further accelerated as secondary air is sucked in through the louver by suction of a blower from a discharge port 2-12 at the center of the separator core. Thus, fine powder is collected at the center of the separator core by centrifugal force, whereas coarse powder is passed through a gap 4-6 between the louver and the separator core and collected at a hopper 4-3. Suitable examples of this conventional classifier include DSX CLASSIFIER manufactured by Nippon Pneumatic Mfg. Co., Ltd.

Figure 5:
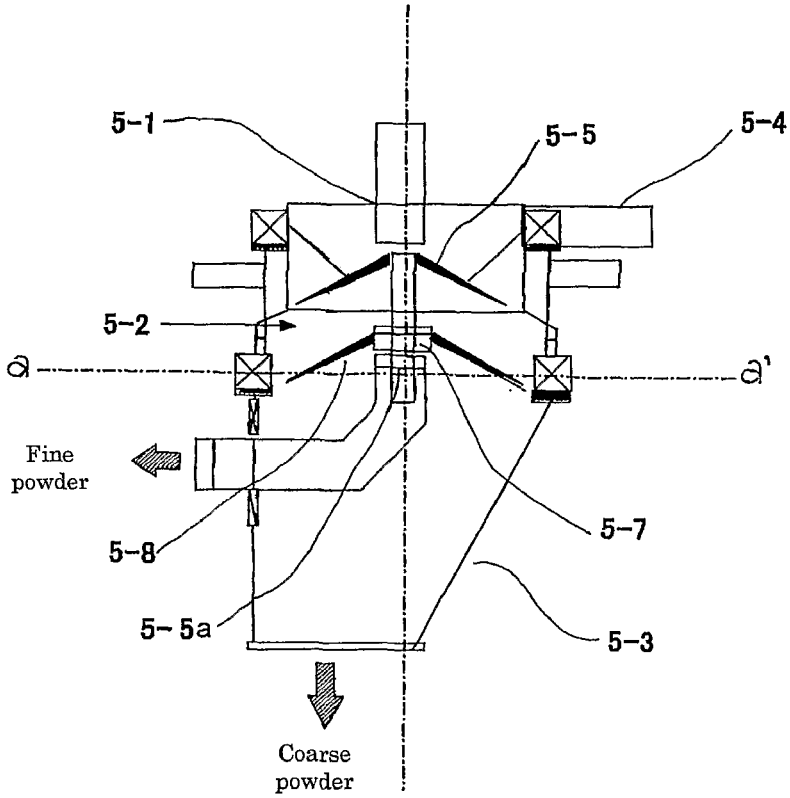
FIG. 5 is a schematic diagram showing the structure according to another embodiment of the classifier of the present invention.

A second embodiment of a coarse powder classifier used in the pulverizing and coarse powder classifying apparatus of the present invention is shown in FIG. 5. This coarse powder classifier is applied to the coarse powder classifier in the pulverizing and classifying step shown in FIG. 1.

Figure 4:
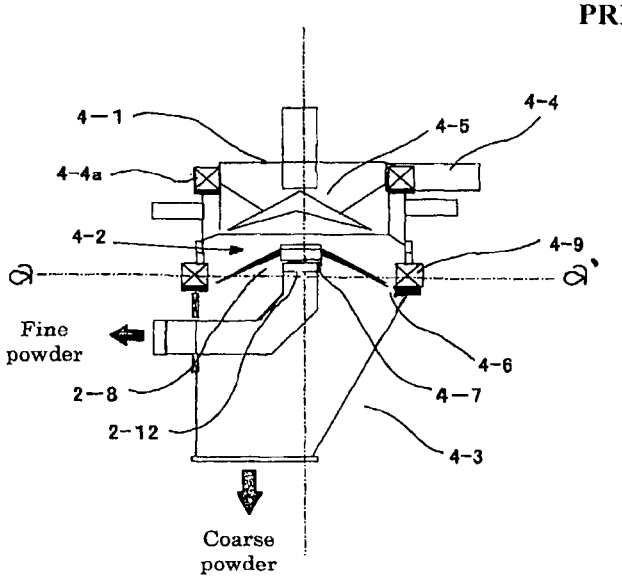
FIG. 4 PRIOR ART
FIG. 4 is a schematic diagram showing another embodiment of a conventional structure of the classifier.

In the present embodiment, in addition to the components of the conventional classifier in FIG. 4, a discharge pipe 5-5*a* is installed at the center of a center core 5-5 of a cyclone classifier in such a manner as to face a separator core 5-8 in a classification chamber. When a pulverized material flows in circles inside a collector inner portion 1 after flowing from a collector inlet 4, the swirling velocity of the pulverized material is further increased by suction of the discharge pipe 5-5*a*, extra swirling flows are produced by a primary louver 5-4, which gives a synergistic effect, and the swirling velocity becomes higher than that inside a collector inner portion of a conventional classifier, thereby improving dispersibility. At the same time, due to the dispersion, ultra-fine powder contained in the pulverized material is discharged from the discharge pipe 5-5*a* to the fine powder side via a fine powder discharge port 5-7 of the separator core provided in a classification chamber 5-2. Thus, in a conventional dispersion chamber as well, classifying function is added, and ultra-fine powder is separated beforehand through the discharge pipe 5-5*a*. Specifically, since the discharge pipe 5-5*a* makes two-staged classification possible within the same classifier, classification accuracy improves remarkably. As to a pulverizing apparatus, TURBO MILL manufactured by Turbo Kogyo Co., Ltd., for example, is used as a mechanical pulverizer using a rotor which rotates, to carry out pulverization and classification.

A toner was produced as described below, using the pulverizing and coarse powder classifying apparatus of the present embodiment.

When a toner raw material was pulverized and classified as in the first embodiment, it was possible to obtain a toner whose weight-average particle diameter was 7.8 μm, in which the number-average percentage of fine powder of 4 μm or less in particle diameter was 11% by number and the weight-average percentage of coarse powder of 16 μm or less in particle diameter was 1.0% by weight, by as much as 86% by weight (relative to the total amount of toner).

Third Embodiment

In a third embodiment that represents a fine powder classifying apparatus of the present invention, a classifier which is similar in structure to the classifier of the first embodiment is used as fine powder classifiers 8 and 14 in the fine powder classifying step shown in FIG. 1.

The fine powder classifying apparatus of the third embodiment is characterized in that a fine powder discharge pipe is provided at the center of a center core installed in a dispersion chamber at an upper part of the fine powder classifying apparatus, in the fine powder classifying step in which fine powder is separated from toner that has been pulverized by any one of the pulverizing and classifying apparatuses described in the first and second embodiments.

Figure 2:
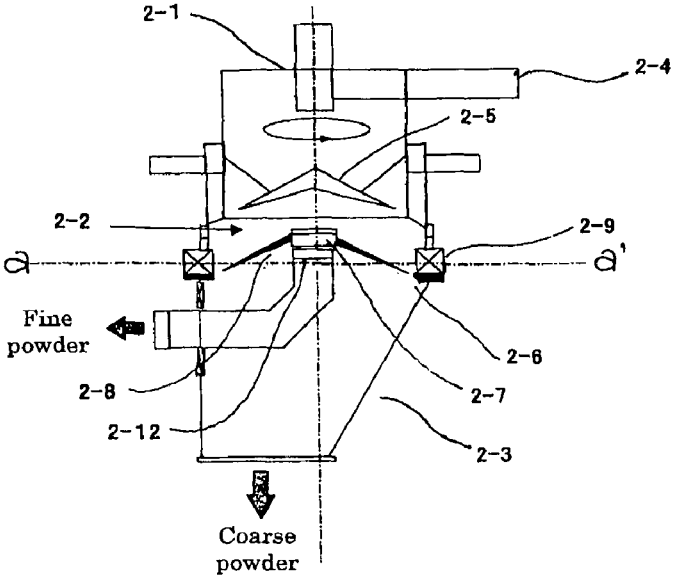
FIG. 2 PRIOR ART
FIG. 2 is a schematic diagram showing a conventional structure of a classifier.

FIG. 2 shows the structure of a conventional classifier, which is utilized for fine powder classifiers 8 and 14 in FIG. 1. In the cyclone classifier, a toner jet introduced from 2-4 is swirled by an upper center core 2-1 and thus dispersed, then passes a center core 2-5 placed at a lower part of a collector, and flows into a classification chamber 2-2. A separator core 2-8 and a louver 2-9 are placed in the vicinity of the classification chamber, and the swirling flow is further accelerated as secondary air is sucked in through the louver by suction of a blower from a discharge port 2-12 at the center of the separator core. Thus, fine powder is collected at the center of the separator core by centrifugal force, whereas coarse powder is passed through a gap 2-6 between the louver and the separator core and collected at a hopper 2-3. Suitable examples of this conventional classifier include DS CLASSIFIER manufactured by Nippon Pneumatic Mfg. Co., Ltd.

A method for producing a toner for developing latent electrostatic images according to the present embodiment is characterized by a toner producing manner in the fine powder classifying step. In a classifier shown in FIG. 3, a discharge pipe 3-5*a* is installed at the center of a center core 3-5 located at an upper part of the cyclone classifier, in such a manner as to face a separator core 3-8 in a classification chamber. When a pulverized material flows in circles inside a collector inner portion 1 after flowing from a collector inlet 4, the swirling velocity of the pulverized material is further increased by suction of the discharge pipe 3-5*a*, and the swirling velocity becomes higher than that inside a collector inner portion of a conventional classifier, thereby improving dispersibility. At the same time, due to the dispersion, ultra-fine powder contained in the pulverized material is discharged from the discharge pipe 3-5*a* to the fine powder side via a fine powder discharge port 7 of the separator core provided in a classification chamber 3-2. Thus, in a conventional dispersion chamber as well, classifying function is added, and ultra-fine powder is separated beforehand through the discharge pipe 3-5*a*. Specifically, since the discharge pipe 3-5*a* makes two-staged classification possible within the same classifier, classification accuracy improves remarkably.

A toner was produced as described below, using the fine powder classifying apparatus of the present embodiment.

When a toner raw material was pulverized and classified as in the first embodiment, it was possible to obtain a toner whose weight-average particle diameter was 7.8 μm, in which the number-average percentage of fine powder of 4 μm or less in particle diameter was 11% by number and the weight-average percentage of coarse powder of 16 μm or less in particle diameter was 1.0% by weight, by as much as 88% by weight (relative to the total amount of toner).

Fourth Embodiment

In a fourth embodiment that represents a fine powder classifying apparatus of the present invention, a classifier which is similar in structure to the classifier of the second embodiment is used for the fine powder classifiers 8 and 14 in the fine powder classifying step shown in FIG. 1.

A toner was produced as described below, using the fine powder classifying apparatus of the present embodiment.

When a toner raw material was pulverized and classified as in the first embodiment, it was possible to obtain a toner whose weight-average particle diameter was 7.8 μm, in which the number-average percentage of fine powder of 4 μm or less in particle diameter was 10% by number and the weight-average percentage of coarse powder of 16 μm or less in particle diameter was 1.0% by weight, by as much as 89% by weight (relative to the total amount of toner).

Fifth Embodiment

Figure 6:
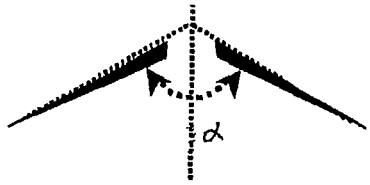
FIG. 6 is a schematic diagram showing an apex angle α.

A fifth embodiment that represents a coarse powder classifier used in the pulverizing and coarse powder classifying apparatus of the present invention provides the coarse powder classifier according to the first embodiment, wherein the center core, which is installed in a dispersion chamber at an upper part of the cyclone classifier and which has at its center the fine powder discharge pipe, has an apex angle $\alpha 1$ that is defined to satisfy the relationship $90° \leqq \alpha 1 \leqq 140°$. When the apex angle of the center core, which determines the apex angle of the center core in FIG. 6, is less than 90°, the height of the collector increases, so that the swirling velocity of the pulverized material in moving as far as the classification chamber decreases, and thus classification accuracy lowers. When the apex angle of the center core is greater than 140°, the pulverized material does not undergo change in the volume of the collector inner portion in moving as far as the classification chamber, so that a satisfactory swirling flow cannot be obtained. With the definition, the volume of the collector inner portion is made appropriate, becoming smaller toward the classification chamber 2-2, (3-2), (5-2), and so the swirling flow can be conveyed to the classification chamber without decreasing its speed; therefore, classification accuracy improves.

A toner was produced as described below, using the pulverizing and coarse powder classifying apparatus of the present embodiment.

When a toner was produced using a toner raw material and a flow of steps that are similar to those of the first embodiment, with the apex angle of the center core set at 100°, it was possible to obtain a toner whose weight-average particle diameter was 7.7 μm, in which the number-average percentage of fine powder of 4 μm or less in particle diameter was 10% by number and the weight-average percentage of coarse powder of 16 μm or less in particle diameter was 0.7% by weight, by as much as 87% by weight (relative to the total amount of toner).

Sixth Embodiment

Figure 7:
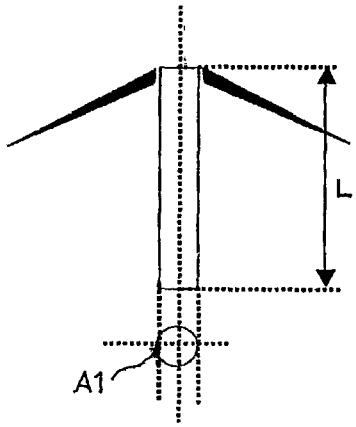
FIG. 7 is a schematic diagram showing the structure of a fine powder discharge pipe.
Figure 8:
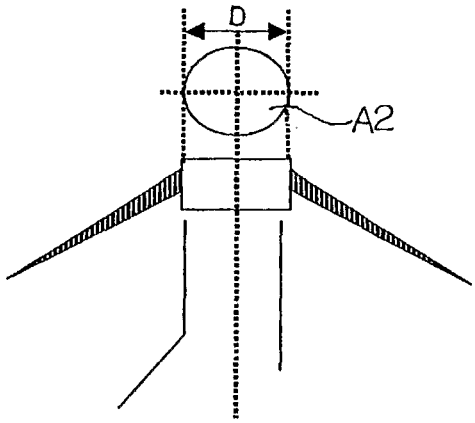
FIG. 8 is a schematic diagram showing the structure of a separator core.

A sixth embodiment that represents a coarse powder classifier used in the pulverizing and coarse powder classifying apparatus of the present invention is characterized by defining to a specific range the diameter of the discharge port at the center of the center core which is installed in the dispersion chamber at the upper part of the cyclone classifier of the first embodiment and which has at its center the fine powder discharge pipe. Specifically, the sixth embodiment provides a classifier wherein an opening area A1 of the fine powder discharge pipe in FIG. 7 and an opening area A2 of the separator core in FIG. 8 are defined to satisfy the relationship $1/10 \times A2 \leqq A1 \leqq 8/10 \times A2$. Thus, the definition of the diameter of the fine powder discharge port in the center core makes it possible to reduce inflow of coarse powder in the coarse powder classifying step and reduce inflow of fine powder in the fine powder classifying step. Consequently, since the powders can be conveyed to the classification chamber, classification accuracy improves.

A toner was produced as described below, using the pulverizing and coarse powder classifying apparatus of the present embodiment.

When a toner was produced using a toner raw material and a flow of steps that are similar to those of the first embodiment, with the opening area of the center core set at $6/10 \times A2$, it was possible to obtain a toner whose weight-average particle diameter was 7.6 μm, in which the number-average percentage of fine powder of 4 μm or less in particle diameter was 10% by number and the weight-average percentage of coarse powder of 16 μm or less in particle diameter was 0.7% by weight, by as much as 87% by weight (relative to the total amount of toner).

Seventh Embodiment

A seventh embodiment that represents a coarse powder classifier used in the pulverizing and coarse powder classifying apparatus of the present invention is characterized by defining to a specific range a length L of the fine powder discharge pipe provided at the center of the center core which is installed in the dispersion chamber at the upper part of the cyclone classifier of the first embodiment and which has at its center the fine powder discharge pipe. Specifically, the seventh embodiment provides a classifier wherein the length L of the fine powder discharge pipe in FIG. 7 and an opening diameter D of the separator core in FIG. 8 are defined to satisfy the relationship $1 \times D \leqq L \leqq 4 \times D$. Thus, suction at the center of the center core becomes stable, and it becomes possible to reduce inflow of coarse powder in the coarse powder classifying step and reduce inflow of fine powder in the fine powder classifying step. Consequently, since the powders can be conveyed to the classification chamber, classification accuracy improves.

A toner was produced as described below, using the pulverizing and coarse powder classifying apparatus of the present embodiment.

When a toner was produced using a toner raw material and a flow of steps that are similar to those of the first embodiment, with the opening area of the center core set at 6/10×A2, it was possible to obtain a toner whose weight-average particle diameter was 7.7 μm, in which the number-average percentage of fine powder of 4 μm or less in particle diameter was 11% by number and the weight-average percentage of coarse powder of 16 μm or less in particle diameter was 0.6% by weight, by as much as 87% by weight (relative to the total amount of toner).

Eighth Embodiment

Figure 9:
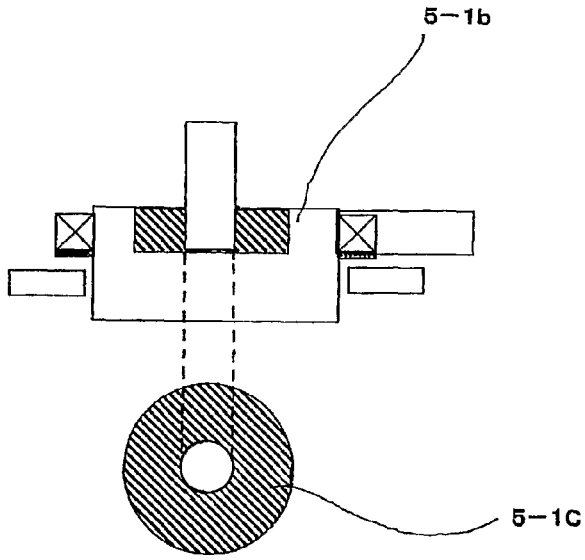
FIG. 9 is a schematic diagram showing the structure of an upper lid.

An eighth embodiment that represents a coarse powder classifier used in the pulverizing and coarse powder classifying apparatus of the present invention is characterized in that a flow maldistribution preventing jig 5-1*c* shown in FIG. 9 is provided on an upper lid of the cyclone classifier of the first embodiment. As to this flow maldistribution preventing jig 5-1*c*, a donut-shaped ring is provided to an exhaust pipe at the center of the collector; therefore, the volume of the collector inner portion becomes smaller, stagnation at the center of the swirling flow is reduced, and it becomes possible to reduce inflow of coarse powder in the coarse powder classifying step and reduce inflow of fine powder in the fine powder classifying step. Consequently, since the powders can be conveyed to the classification chamber, classification accuracy improves.

A toner was produced as described below, using the pulverizing and coarse powder classifying apparatus of the present embodiment.

When a toner was produced using a toner raw material and a flow of steps that are similar to those of the first embodiment, with the opening area of the center core set at 6/10×A2, it was possible to obtain a toner whose weight-average particle diameter was 7.7 μm, in which the number-average percentage of fine powder of 4 μm or less in particle diameter was 11% by number and the weight-average percentage of coarse powder of 16 μm or less in particle diameter was 0.6% by weight, by as much as 88% by weight (relative to the total amount of toner).

Ninth Embodiment

A ninth embodiment that represents a coarse powder classifier used in the pulverizing and coarse powder classifying apparatus of the present invention is characterized in that a flow maldistribution preventing jig is provided on an upper lid 5-1*b* of the cyclone classifier of the first embodiment. As to this flow maldistribution preventing jig, the flow maldistribution preventing jig 5-1*c* in the shape of a donut-like ring is provided to the exhaust pipe at the center of the collector as shown in FIG. 9, and a volume V1 of the flow maldistribution preventing jig and a volume V2 of the dispersion chamber are defined to satisfy the relationship $3/10\times V2 \leqq V1 \leqq 8/10\times V2$; therefore, the volume of the collector inner portion is controlled, stagnation at the center of the swirling flow is reduced, and it becomes possible to reduce inflow of coarse powder in the coarse powder classifying step and reduce inflow of fine powder in the fine powder classifying step. Consequently, since the powders can be conveyed to the classification chamber, classification accuracy improves.

A toner was produced as described below, using the pulverizing and coarse powder classifying apparatus of the present embodiment.

When a toner was produced using a toner raw material and a flow of steps that are similar to those of the first embodiment, with the opening area of the center core set at 6/10×A2, it was possible to obtain a toner whose weight-average particle diameter was 7.7 μm, in which the number-average percentage of fine powder of 4 μm or less in particle diameter was 10% by number and the weight-average percentage of coarse powder of 16 μm or less in particle diameter was 0.6% by weight, by as much as 88% by weight (relative to the total amount of toner).

Tenth Embodiment

A tenth embodiment that represents a coarse powder classifier used in the pulverizing and coarse powder classifying apparatus of the present invention is characterized in that a flow maldistribution preventing jig is provided on the upper lid 5-1*b* of the cyclone classifier of the first embodiment. As to this flow maldistribution preventing jig, the flow maldistribution preventing jig 5-1*c* in the shape of a donut-like ring is provided to the exhaust pipe at the center of the collector as shown in FIG. 9, and a basal area VA1 of the flow maldistribution preventing jig is defined to satisfy the relationship $2/10\times VA2 \leqq VA1 \leqq 7/10\times VA2$; therefore, the volume of the collector inner portion is controlled, stagnation at the center of the swirling flow is reduced in the internal diameter direction, and it becomes possible to reduce inflow of coarse powder in the coarse powder classifying step and reduce inflow of fine powder in the fine powder classifying step. Consequently, since the powders can be conveyed to the classification chamber, classification accuracy improves.

Here, VA2 denotes a cross-sectional area of the classifier in FIG. 5, as it is cut along the broken line a-a'.

A toner was produced as described below, using the pulverizing and coarse powder classifying apparatus of the present embodiment.

When a toner was produced using a toner raw material and a flow of steps that are similar to those of the first embodiment, with the opening area of the center core set at 6/10×A2, it was possible to obtain a toner whose weight-average particle diameter was 7.7 μm, in which the number-average percentage of fine powder of 4 μm or less in particle diameter was 10% by number and the weight-average percentage of coarse powder of 16 μm or less in particle diameter was 0.5% by weight, by as much as 88% by weight (relative to the total amount of toner).

As is evident from the first to tenth embodiments, the toners obtained using the pulverizing and coarse powder classifying apparatus and the fine powder classifying apparatus of the present invention are of sharp particle size distribution. Therefore, the charge amounts of the toners are stable, the toners can be favorably used in terms of reducing background smear and transfer failure, and thus stable image quality can be realized.

The invention claimed is:

1. A pulverizing and coarse powder classifying apparatus comprising:

a mechanical pulverizer that pulverizes a powder raw material, a cyclone that collects pulverized powder, and a coarse powder classifier that separates coarse powder from the collected powder, wherein the coarse powder classifier is a cyclone classifier including a dispersion chamber equipped with a center core and used for dispersing the powder, and a classification chamber equipped with a separator core, and wherein the center core has at its center a fine powder discharge pipe.

2. The pulverizing and coarse powder classifying apparatus according to claim 1, wherein the dispersion chamber includes a secondary airflow vane.

3. The pulverizing and coarse powder classifying apparatus according to claim 1, wherein an apex angle $\alpha 1$ of the center core satisfies the following relationship:

$$90° \leqq \alpha 1 \leqq 140°.$$

4. The pulverizing and coarse powder classifying apparatus according to claim 1, wherein an opening area A1 of the fine powder discharge pipe and an opening area A2 of the separator core satisfy the following relationship:

$$1/10 \times A2 \leqq A1 \leqq 8/10 \times A2.$$

5. The pulverizing and coarse powder classifying apparatus according to claim 1, wherein a length L of the fine powder discharge pipe and an opening diameter D of the separator core satisfy the following relationship:

$$1 \times D \leqq L \leqq 4 \times D.$$

6. The pulverizing and coarse powder classifying apparatus according to claim 1, wherein the coarse powder classifier comprises an upper lid which includes a flow maldistribution preventing portion at its center.

7. The pulverizing and coarse powder classifying apparatus according to claim 6, wherein a volume V1 of the flow maldistribution preventing portion and a volume V2 of the dispersion chamber satisfy the following relationship:

$$3/10 \times V2 \leqq V1 \leqq 8/10 \times V2.$$

8. The pulverizing and coarse powder classifying apparatus according to claim 6, wherein a basal area VA1 of the flow maldistribution preventing portion and a cross-sectional area VA2 of the dispersion chamber in an a-a' direction satisfy the following relationship:

$$2/10 \times VA2 \leqq VA1 \leqq 7/10 \times VA2.$$

9. The pulverizing and coarse powder classifying apparatus according to claim 1, wherein the pulverizing and coarse powder classifying apparatus employs closed-circuit pulverization.

10. A pulverizing and fine powder classifying apparatus comprising:

a dispersion chamber equipped with a center core and used for dispersing powder, and a classification chamber equipped with a separator core, wherein the fine powder classifying apparatus is a cyclone classifier, and the center core has at its center a fine powder discharge pipe, wherein the fine powder classifying apparatus separates fine powder from the powder from which coarse powder has been separated by a pulverizing and coarse powder classifying apparatus, and wherein the pulverizing and coarse powder classifying apparatus comprises a mechanical pulverizer that pulverizes a powder raw material, a cyclone that collects pulverized powder, and a coarse powder classifier that separates the coarse powder from the collected powder, in which the coarse powder classifier is a cyclone classifier including a dispersion chamber equipped with a center core and used for dispersing the powder, and a classification chamber equipped with a separator core, and in which the center core has at its center a fine powder discharge pipe.

11. The pulverizing and fine powder classifying apparatus according to claim 10, wherein the dispersion chamber of the pulverizing and coarse powder classifying apparatus includes a secondary airflow vane.

12. The pulverizing and fine powder classifying apparatus according to claim 10, wherein an apex angle $\alpha 1$ of the center core of the pulverizing and coarse powder classifying apparatus satisfies the following relationship:

$$90° \leqq \alpha 1 \leqq 140°.$$

13. The pulverizing and fine powder classifying apparatus according to claim 10, wherein an opening area A1 of the fine powder discharge pipe and an opening area A2 of the separator core of the pulverizing and coarse powder classifying apparatus satisfy the following relationship:

$$1/10 \times A2 \leqq A1 \leqq 8/10 \times A2.$$

14. The pulverizing and fine powder classifying apparatus according to claim 10, wherein a length L of the fine powder discharge pipe and an opening diameter D of the separator core of the pulverizing and coarse powder classifying apparatus satisfy the following relationship:

$$1 \times D \leqq L \leqq 4 \times D.$$

15. The pulverizing and fine powder classifying apparatus according to claim 10, further comprising an upper lid which includes a flow maldistribution preventing portion at its center.

16. The pulverizing and fine powder classifying apparatus according to claim 15, wherein a volume V1 of the flow maldistribution preventing portion and a volume V2 of the dispersion chamber of the pulverizing and coarse powder classifying apparatus satisfy the following relationship:

$$3/10 \times V2 \leqq V1 \leqq 8/10 \times V2.$$

17. The pulverizing and fine powder classifying apparatus according to claim 15, wherein a basal area VA1 of the flow maldistribution preventing portion and a cross-sectional area VA2 of the dispersion chamber of the pulverizing and coarse powder classifying apparatus in an a-a' direction satisfy the following relationship:

$$2/10 \times VA2 \leqq VA1 \leqq 7/10 \times VA2.$$

* * * * *